US005318067A

United States Patent [19]

Day

[11] Patent Number: 5,318,067

[45] Date of Patent: Jun. 7, 1994

[54] SIMPLIFIED FULLY AUTOMATIC UMBRELLA

[76] Inventor: Sheng-Tong Day, No. 1, Chung Yang North Road, Ching-shui, Taichung, Taiwan

[21] Appl. No.: 105,813

[22] Filed: Aug. 11, 1993

[51] Int. Cl.[5] ..... A45B 25/14

[52] U.S. Cl. ..... 135/22; 135/25.1; 135/41

[58] Field of Search ..... 135/15.1, 22–24, 135/25.1, 28, 25.41, 25.33, 37, 38, 39, 40, 41

[56] References Cited

U.S. PATENT DOCUMENTS

| | | | |
|---|---|---|---|
| 638,700 | 12/1899 | Cameron . | |
| 3,680,571 | 8/1972 | Houston | 135/22 |
| 3,729,012 | 4/1973 | Weber | 135/22 X |
| 3,856,030 | 12/1974 | Sato | 135/22 |
| 4,951,590 | 8/1990 | Kassbaum | 135/22 X |
| 5,224,505 | 7/1993 | Wu | 135/24 |

FOREIGN PATENT DOCUMENTS

| | | | |
|---|---|---|---|
| 143699 | 8/1903 | Fed. Rep. of Germany | 135/22 |
| 349633 | 6/1905 | France | 135/22 |
| 380266 | 7/1907 | France | 135/22 |

*Primary Examiner*—Carl D. Friedman
*Assistant Examiner*—Lan C. Mai
*Attorney, Agent, or Firm*—Pro-Techtor International

[57] ABSTRACT

An improvement on simplified fully automatic umbrella is disclosed. This umbrella comprises a shank consisting of an inner tube and an outer tube, the inner tube has at upper section a middle ring and an extension while the outer tube has at upper end a lower ring with an upper pawl; an umbrella opening spring received within the extension; a cylinder mounted around the extension and provided at lower end with an upper ring; an umbrella closing spring mounted around the inner tube; an actuating mechanism consisting of a push button, an upper insert containing a compression spring, a lower insert containing a lower pawl, an actuator and a detent, and a wire interconnected between the two inserts; a canopy structure connected to the upper, middle and lower rings; and a handle provided at bottom of the outer tube.

6 Claims, 4 Drawing Sheets

SIMPLIFIED FULLY AUTOMATIC UMBRELLA

FIELD OF THE INVENTION

This invention relates to a simplified fully automatic umbrella, particularly to an improvement on the actually mechanism of the automatic umbrella.

BACKGROUND OF THE INVENTION

U.S.A. patent application Ser. No. 07/977,568 filed by this same inventor disclosed a simplified fully automatic umbrella. Upon exploitation the present inventor found that the actuating mechanism and its operation can be further simplified and improved to reduce the probablities of malfunction. Thus, this invention is accomplished for this purposes.

SUMMARY OF THE INVENTION

It is, therefore, an object of the present invention to provide an improvement of actuating mechanism in the simplified fully automatic umbrella.

This object is achieved by an automatic umbrella according to the present application which comprises a shank consisting of an inner and an outer tubes capable of relative sliding movement with respect to each other, in which said inner tube provided at upper section with a middle ring and an extension and formed along the length with upper, middle and lower lock holes, while said outer tube provided at upper end a lower ring with an upper pawl and formed with an upper slot and a lower lock hole; an umbrella opening spring telescopically received within said extension of said inner tube; a cylinder mounted around said extension for sliding movement relative thereto and provided at lower end with an upper ring; an umbrella closing spring telescopically mounted around said inner tube within the limits between said middle ring and the top end of said outer tube; an actuating mechanism consisting of a push button, an upper insert containing a compression spring, a lower insert containing a lower pawl, an actuator and a detent in interaction relationship, and a wire interconnected between said upper and lower inserts; a canopy structure connected with said upper, middle and lower rings corresponding in conventional manner; and a handle provided at lower end of said outer tube of the umbrella shank.

The foregoing and other objects, features and advantages of the invention will be apparent from the following particular description of preferred embodiments of the invention as illustrated in the accompanying drawings.

DETAILED DESCRIPTION OF PREFERRED EMBODIMENTS

Figure 1:
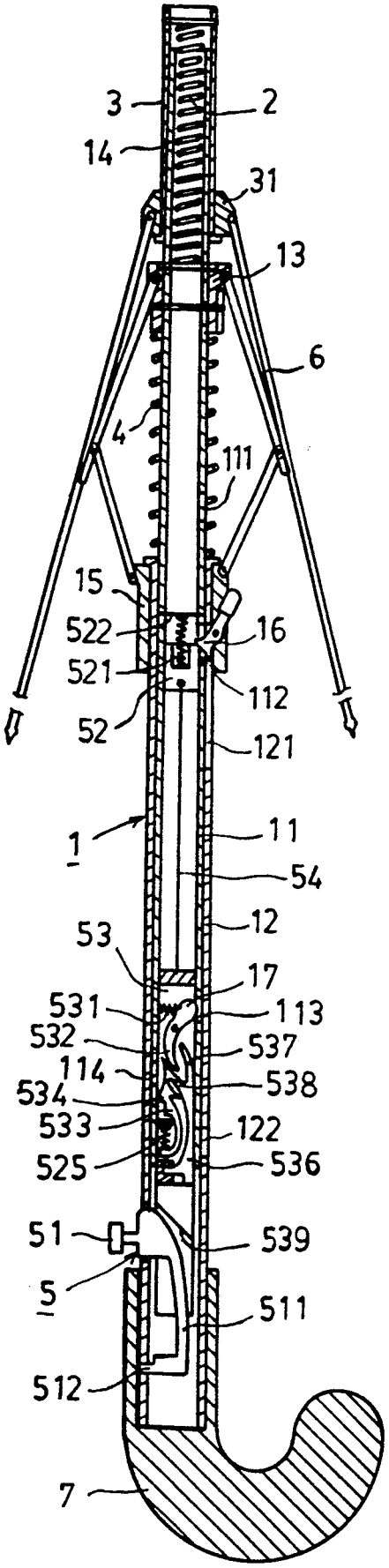
FIG. 1 is an elevational cross section illustrating the automatic umbrella according to the invention in the closed state.

Now, referring to FIG. 1, the preferred embodiment of the automatic umbrella according to the present invention essentially comprises a shank 1, an umbrella opening spring 2, a cylinder 3, an unmbrella closing spring 4, an actuating mechanism 5, a canopy structure 6 and a handle 7, in which said shank 1, said umbrella opening spring 2, said cylinder 3 and said umbrella closing spring 4 are substantially similar to that disclosed in mentioned prior application Ser. No. 07/977,568 which is incorporated herein for reference, while said canopy structure 6 and said handle 7 are well known, so that the characteristic feature of the present invention resides at said actuating mechanism 5.

The shank 1 consists of an inner tube 11 and an outer tube 12 capable of sliding movement relative to each other. Said inner tube 11 is provided at upper section with a middle ring 13 and an extension 14 outreached over said middle ring 13, and formed along the length with an upper hole 111, a middle hole 112 and a lower hole 113, as well as a lock hole 114 opposite thereto. Said outer tube 12 is provided at upper end with a lower ring 15 which is slidable relative to said outer tube 12, and formed with an upper slot 121 and a lower aperture 122. On said lower ring 15 an upper pawl 16 is provided and biased inwards by a hair spring, not shown.

The umbrella opening spring 2 is telescopically received within said extension 14 of said inner tube 11. Said extension 14 is housed within said cylinder 3 which is slidable relative to said extension 14 in response to the telescopic action of said umbrella opening spring 2. The cylinder 3 is provided with an upper ring 31 at lower end.

The umbrella closing spring 4 is telescopically mounted around said inner tube 11 within the limits between said middle ring 13 and the top end of said outer tube 12. Said outer tube 12 is slidable relative to said inner tube 11 in response to the telescopic action of said umbrella closing spring 4.

The actuating mechanism 5 consists of a push button 51, an upper insert 52 and a lower insert 53, and a wire 54 interconnected between said inserts 52, 53. The button 51 is connected at inner side with an elastic press member 511 which at distal end 512 is secured inside of said outer tube 12. In said upper insert 52 a compression spring 521 is received and the protruded top end of said spring 521 is restricted by a transverse stop pin 522. The lower insert 53 contains a lower pawl 17 an actuator 533 and a detent 536 in interaction relationship. Said lower pawl 17 is biased outwards by means of an expansion spring 531 and extended downwards at its free end 532. The actuator 533 is formed with two steps, namely first or upper step and second or lower step, as shown at inner side, i.e. the left side in view of the drawing, and a protrusion 534 at opposite or outer side. The trailing end of said actuator 533 engaged with a return spring 535 while the leading end is entered into the field of said free end 532 of said lower pawl 17. The detent 536 at lower end is secured inside of said lower insert 53 and at upper end is forked to form a finger 537 and a claw 538. Said finger 537 is also entered into the field of said free end 532 of said lower pawl 17 opposite to said leading end of said actuator 533 with respect to said free end 532. The claw 538 is either engaged into said first or second step of said actuator 533 depending upon whether the umbrella is at closed or open status, as referred hereinafter. The lower insert 53 is configured to have an inclined bottom surface 539 for readily driven when the push button 51 is pressed down to contact thereon. The wire 54 is rigidly interconnected between the lower side of said upper insert 52 and the upper side of said lower insert 53 as illustrated, to serve as the drive means for interaction between said inserts 52, 53.

The canopy structure 6 is just the same as conventional one so that further description is omitted. Anyway, each constituting rib is at one end pivotably connected to said upper, middle and lower rings 31, 13 and 15, correspondingly.

The handle 7 is mounted at bottom of the outer tube 12 of the umbrella shank 1.

In the closed state of the umbrella as shown in FIG. 1, said umbrella closing spring 4 is released, but said upper pawl 16 is still engaged into said middle hole 112 of said inner tube 11 through said upper slot 121 of said outer tube 12, thus retaining said umbrella opening spring 2 in a compressed and energy accumulated state.

Figure 2:
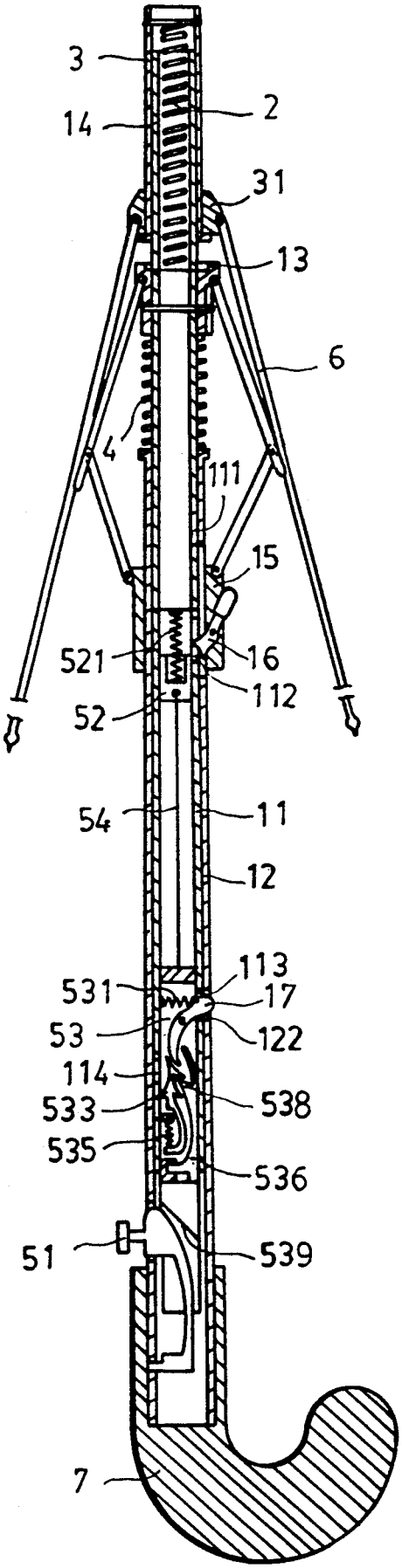
FIG. 2 is similar to FIG. 1 provided illustrating the umbrella in the preparative state ready for opening.

In the preparation to open the umbrella, the user may hold the handle 7 with one hand and put the terminal end of the cylinder 3 against any surface of the ground, a wall or another hand of himself. When a slight force is applied by said one hand, then said outer tube 12 will be slidably moved relative to said inner tube 11 to cause said umbrella closing spring 4 compressed by means of the top end of said outer tube 12. Since said outer tube 12 is slided upwards relative to said inner tube 11 until the lower aperture 122 of said outer tube 12 is aligned with the lower hole 113 of said inner tube 11, the lower pawl 17 under the action of the expansion spring 531 will be biased outwards and engaged into said lower aperture 122 out of said lower hole 113 so as to retain said umbrella closing spring 4 in compressed state, as illustrated in FIG. 2.

For opening the umbrella, it needs only the thumb of the hand that holds the handle 7 to press the push button 51. The lower insert 53 under the action of the elastic press member 511 abutting against its inclined bottom surface 55 is raised slightly, and the upper insert 52 is in turn driven upwards by means of the wire 54 to push the upper pawl 16 off the middle hole 112 of said inner hole 11. So that the umbrella opening spring 2 is released and expanded by means of its own accumulated energy, which causes the middle ring 13 along the inner tube 11 sliding downwards and the lower ring 15 sliding upwards with respect to said outer tube 12, so as to open the canopy structure 4.

Figure 3:
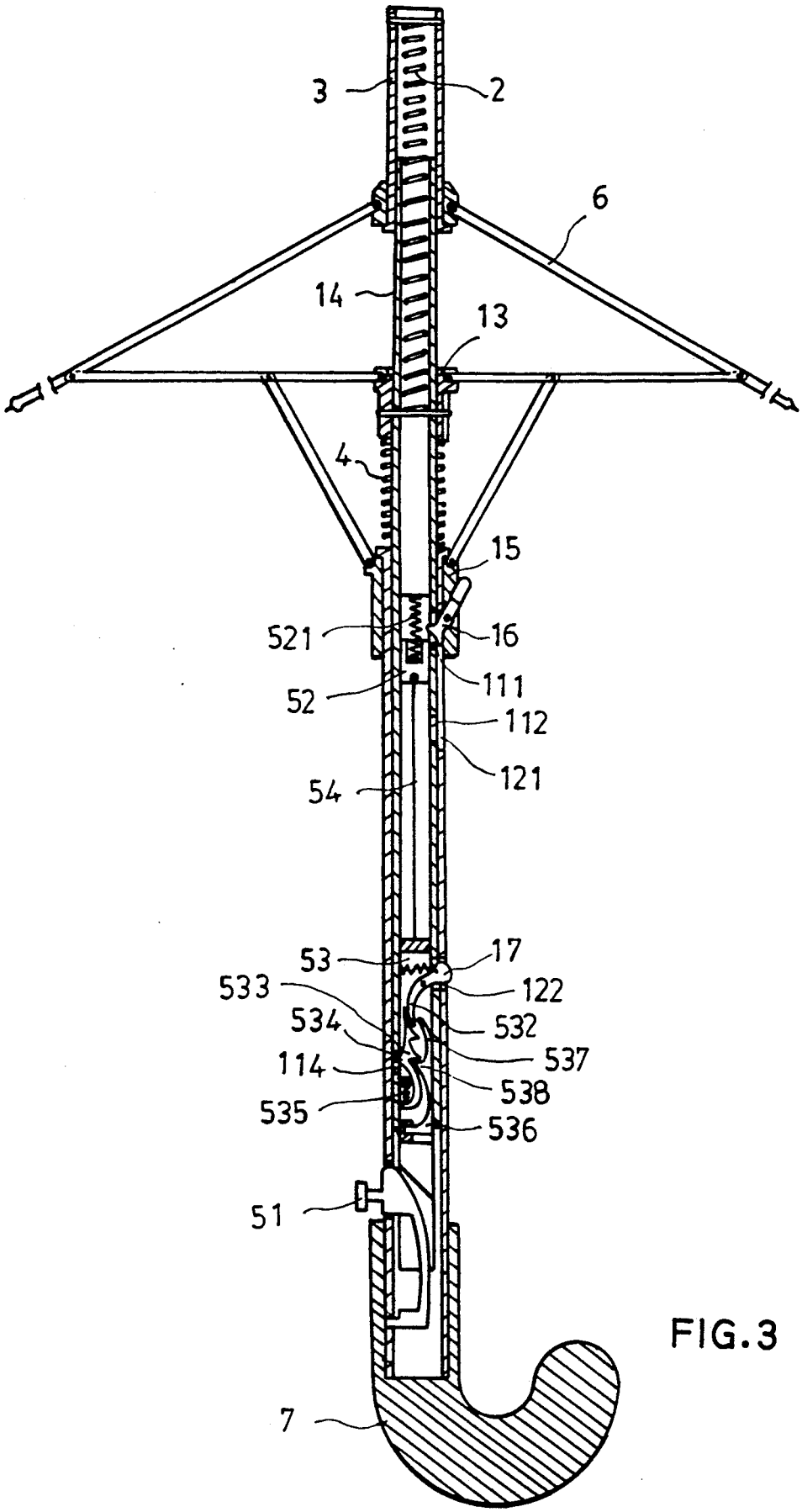
FIG. 3 is similar to FIG. 1 provided illustrating the umbrella in the open state.
Figure 4:
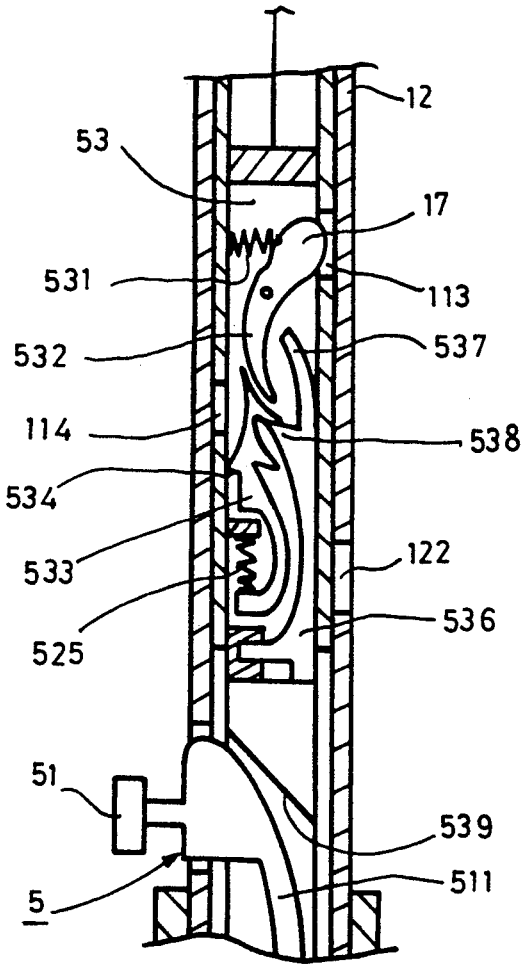
FIG. 4 is a partly enlarged cross section to more clearly illustrate the actuating mechanism.

When said lower insert 53 is moved upwards, the actuator 533 is driven up until its protrusion 534 is engaged into the lock hole 114 to keep the return spring 535 in compressed state. On the other hand, the leading end of said actuator 533 is further entered into the field of the free end 532 of said lower pawl 17. As soon as the force applied to said button 51 is released, the spring 521 compressed by said upper insert 52 is expanded to restore said upper insert 2 to original position. In turn, the lower insert 53 is driven back by means of the wire 54, so that the detent 537 is returned to make its claw 538 retreated with respect to said actuator 533 from the first to the second step, as shown in FIG. 3. In the meantime the upper pawl 16 is engaged into the upper hole 111 of said inner tube 11 to reinforce the stability of said canopy structure 6 against the wind drag.

When the opened umbrella is going to be closed, the user also needs only to press the push button 51 in same manner, to abutt the inclined surface 55 to further raise the actuator 533 of the lower insert 53. Then, the lower pawl 17 will be pushed at its free end 532 by the leading end of said actuator 533 and thus pivoted in such way to retreat sufficiently out of the lower aperture 122 of said outer tube 12. The umbrella closing spring 4 is thereby released and expanded by means of its own accumulated energy, which causes the outer tube 12 moved downwards relative to the inner tube 11 so as to close the canopy structure 6. At the sametime, the umbrella opening spring 2 is compressed by means of the expansion force of said umbrella closing spring 4, returned to the state as shown in FIG. 1.

When the free end 532 of the lower pawl 17 is pushed, the finger 537 of the detent 536 is simultaneously pushed away by said free end 532 and thus the claw 538 is disengaged from the second step of said actuator 533. Then the actuator 533 is pulled down under the action of the return spring 535 so as to make said claw 538 moved with respect to said actuator 533 from the second to the first step.

As mentioned above, the actuating mechanism 5 of the automatic umbrella according to the present invention is remarkably improved and simplified to greatly reduce the probability of malfunction.

Although the invention has been described in detail with reference to its presently preferred embodiment, it will be understood by any person skilled in the art that various modifications, changes and variations can be made without departing from the spirit and scope of the invention.

What I claim is:

1. A fully automatic umbrella comprising, in combination:

a shank consisting of an inner tube and an outer tube capable of sliding movement relative to each other, in which said inner tube being provided at upper section with a middle ring and an extension outreached over said middle ring, and formed along the length with an upper hole, a middle hole and a lower hole as well as a lock hole, while said outer tube being provided at upper end with a lower ring having an upper pawl and formed with an upper slot and a lower aperture;

an umbrella opening spring telescopically received within said extension of said inner tube;

a cylinder mounted around said extension for sliding movement relative thereto and provided at lower end with an upper ring;

an umbrella closing spring telescopically mounted around said inner tube within the limits between said middle ring and the top end of said outer tube;

an actuating mechanism consisting of a push button connected at inner side with an elastic press member;

an upper insert pushing away said upper pawl engaged into said middle hole to release said umbrella opening spring;

an lower insert containing a lower pawl extended downwards at a free end to define a field; an actuator having a leading end and formed at inner side with first and second step and at outer side with a protrusion locking into said lock hole; and a detent having a finger and a claw, said finger as well as the leading end of said actuator being extended into the field of said free end of said lower pawl at opposite sides, and said claw (538) being engaged into either said first step or said second step of said actuator (533) depending upon whether said umbrella being in closed or open status; and a wire interconnected between said upper insert and said lower insert;

a canopy structure connected via respective one end of constituting ribs with said upper, middle and, lower rings correspondingly; and a handle provided at bottom of said outer tube.

2. An fully automatic umbrella according to claim 1, wherein said upper pawl is biased through said upper slot of said outer tube either to retain said umbrella opening spring in a compressed state, or into said, upper hole of said inner tube to reinforce the stability of opened canopy structure.

3. A fully automatic umbrella according to claim 2, where said pawl is pushed away said middle hole when said upper insert is driven upwards, so as to release said umbrella opening spring from its compressed state.

4. A fully automatic umbrella according to claim 1, wherein said lower pawl is biased by an expansion spring through said lower hole of said inner tube into said lower aperture to retain said umbrella closing spring in a compressed state.

5. A fully automatic umbrella according to claim 4, wherein said lower pawl is pivoted against said expansion spring as soon as its free end is pushed away by said actuator and retreated from said lower aperture of said outer tube, so as to release said umbrella closing spring from its compressed state.

6. A fully automatic umbrella according to claim 1, wherein said lower insert is inclined at bottom for readily to be driven upwards by means of said push button.

* * * * *